US005560753A

United States Patent [19]

Schnabel et al.

[11] Patent Number: 5,560,753

[45] Date of Patent: Oct. 1, 1996

[54] COATED ABRASIVE ARTICLE CONTAINING AN ELECTRICALLY CONDUCTIVE BACKING

[75] Inventors: Herbert W. Schnabel, Midlothian, Va.; Scott J. Buchanan, Minneapolis, Minn.; Richard G. McAllister, Sterling, Mass.

[73] Assignee: Minnesota Mining and Manufacturing Company, St. Paul, Minn.

[21] Appl. No.: 469,595

[22] Filed: Jun. 6, 1995

Related U.S. Application Data

[63] Continuation of Ser. No. 834,618, Feb. 12, 1992, abandoned.

[51] Int. Cl.[6] ..... B24B 1/00

[52] U.S. Cl. ..... 51/295; 51/297; 428/141; 428/143; 451/532; 451/539

[58] Field of Search ..... 428/141, 143; 51/295, 297; 451/532, 539

[56] References Cited

U.S. PATENT DOCUMENTS

| | | | |
|---|---|---|---|
| 2,004,466 | 6/1935 | Dietz et al. . | |
| 2,404,207 | 7/1946 | Ball . | |
| 3,163,968 | 1/1965 | Nafus . | |
| 3,166,388 | 1/1965 | Riegger et al. . | |
| 3,168,387 | 2/1965 | Adams . | |
| 3,367,851 | 2/1968 | Filreis et al. . | |
| 3,377,264 | 4/1968 | Duke et al. . | |
| 3,619,150 | 11/1971 | Rinker . | |
| 3,942,959 | 3/1976 | Markoo et al. | 51/295 |
| 3,992,178 | 11/1976 | Markoo et al. | 51/295 |
| 4,347,104 | 8/1982 | Dressler | 162/103 |
| 4,696,835 | 9/1987 | Maus et al. | 427/121 |
| 4,826,508 | 5/1989 | Schwartz et al. | 51/293 |
| 4,909,901 | 3/1990 | McAllister et al. | 51/295 |
| 4,973,338 | 11/1990 | Gaeta et al. | 51/295 |
| 5,061,294 | 10/1991 | Harmer et al. | 51/295 |
| 5,108,463 | 4/1992 | Buchanan | 51/295 |
| 5,137,542 | 8/1992 | Buchanan . | |

FOREIGN PATENT DOCUMENTS

| | | | |
|---|---|---|---|
| 67400/74 | 2/1975 | Australia | B24D 11/02 |
| 0414494B1 | 2/1991 | European Pat. Off. . | |
| 7720014 | 6/1977 | Germany . | |
| 58-171264 | 10/1983 | Japan . | |
| 61-152373 | 7/1986 | Japan . | |
| 885192 | 12/1961 | United Kingdom . | |
| 2018811 | 10/1979 | United Kingdom | B24D 11/00 |
| WO92/01536 | 7/1991 | WIPO . | |

OTHER PUBLICATIONS

"Pigment Carbon Black for Plastics," *Technical Bulletin Pigments,* No. 40, Degussa, Mar. 1988, pp. 2–23.

"Carbon Black for Conductive Plastics," *Technical Bulletin Pigments*, No. 69, Degussa.* For purposes of examining the present application, this reference was published more than one year prior to the filing date (i.e., Feb. 12, 1992) of the parent to the present application.

Japanese Abstract No. 61–265279 (Inabe et al.).

Japanese Abstract No. 61–033868 (Sakai et al.).

Japanese Abstract No. 58–177270 (Inoue).

*Primary Examiner*—James J. Bell

*Attorney, Agent, or Firm*—Gary L. Griswold; Walter N. Kirn; Gregory D. Allen

[57] ABSTRACT

A coated abrasive article having a backing comprising a sufficient amount of an electrically conductive material therein to reduce the buildup of static electricity during the use of the article. In another aspect, a method of making the same is taught.

30 Claims, 2 Drawing Sheets

COATED ABRASIVE ARTICLE CONTAINING AN ELECTRICALLY CONDUCTIVE BACKING

This is a Continuation of application Ser. No. 07/834,618, filed on Feb. 12, 1992 now abandoned.

BACKGROUND OF THE INVENTION

1. Field of the Invention

This invention pertains to a coated abrasive article having an electrically conductive material incorporated into the backing thereof; and a method of making the same. The abrasive article is useful in reducing the accumulation of the static electric charge in the abrasive article during abrading of a workpiece.

2. Description of the Related Art

Coated abrasives, considered the premier tool for abrading and finishing wood and wood-like materials, unfortunately suffer fron the generation of static electricity during their use. Static electricity generated by the constant separation of the abrasive product from the workpiece, the machinery drive rolls, idler rolls, and support pad for the abrasive product. This static charge is typically on the order of 50 to 100 kilovolts.

Static electricity is responsible for numerous problems. For example, a sudden discharge of the accumulated static charge can cause injury to an operator in the form of an electric shock or it can cause the ignition of wood dust particles, which poses a serious threat of fire or explosion. The static charge also causes the sawdust to cling to various surfaces, including that of the coated abrasive, the abrading machine and the electrically insulating wood workpiece, thereby making it difficult to remove by use of a conventional exhaust system. If the static electrical charge is reduced or eliminated, the coated abrasive article can have a significantly longer useful life and the potential for the above-mentioned hazards can be eliminated or reduced.

Many attempts, with varying degree of success, have been made to solve the static electricity problem. One common approach has been to incorporate an electrically conductive or antistatic material into the coated abrasive construction to eliminate the accumulation of electrical charge. For example, U.S. Pat. No. 3,163,968 (Nafus) discloses a coated abrasive article having a coating comprising graphite in the binder on the surface opposite the abrasive material. U.S. Pat. No. 3,168,387 (Adams) discloses a coated abrasive having a metal leaf pigment over the abrasive grains. U.S. Pat. No. 3,377,264 (Duke) discloses an electrically conductive layer, such as a metal foil, overlying the front surface of a coated abrasive.

U.S. Pat. No. 3,942,959 (Markoo et al.) teaches a coated abrasive construction having an electrically conductive resin layer sandwiched between two electrically nonconductive resin layers to prevent the accumulation of electrostatic charge during grinding. In the latter construction, the resin layer is made electrically conductive by incorporating into the resin an electrically conductive filler which may be a metal alloy, metal pigment, metal salt, or metal complex.

U.S. Pat. No. 3,992,178 (Markoo et al.) discloses a coated abrasive article having an outer layer comprised of graphite particles in a bonding resin which reduces the electrostatic charges generated during grinding.

U.S. Pat. No. 4,826,508 (Schwartz et al.) discloses a flexible abrasive member comprising a length of flexible fabric that has been treated to render it electrically conductive, an electrically non-conductive mesh layer applied to one surface of the fabric, said non-conductive mesh layer having a multitude of discrete openings therein, and electrodeposited metal adhering to the electrically conductive fabric in each of the openings, the electrodeposited metal having particulate abrasive material embedded therein.

U.S. Pat. No. 5,061,294 (Harmer et al.) teaches a coated abrasive that is rendered conductive by the addition of a doped conjugated polymer.

SUMMARY OF THE INVENTION

The present invention provides a coated abrasive article having a sufficient amount of an electrically conductive material incorporated into the backing thereof to reduce the static electrical problems associated with conventional coated abrasives during the abrading of workpieces. The static electric problems tend to be more pronounced when abrading electrically insulating or semi-insulating workpieces, for example, wood (e.g., pine, oak, cherry, etc.), plastic, mineral (e.g., marble), the like (e.g., particle board or pressed board), or workpieces coated with an insulating material (e.g., lacquer). In another aspect, the present invention provides a method of making the same.

A first coated abrasive article in accordance with the present invention comprises:

(a) a nonwoven, fibrous backing comprising at least one ply, wherein said ply comprises electrically non-conductive fibers and electrically conductive material; and (b) an abrasive layer bonded to one major surface of the backing, wherein the electrically conductive material is at least one of electrically conductive fibers selected from the group consisting of graphite fibers, carbon fibers, metal fibers, electrically conductive polymer fibers, graphite coated fibers, carbon coated fibers, metal coated fibers, electrically conductive polymer coated fibers, and combinations thereof; and electrically conductive particles selected from the group consisting of graphite particles, carbon particles, metal particles, electrically conductive polymer particles, graphite coated particles, carbon coated particles, metal coated particles, electrically conductive polymer coated particles, and combinations thereof; and wherein the electrically conductive material is incorporated into the backing in an amount sufficient to reduce the accumulation of static electric charge in the coated abrasive article during the abrading of a workpiece.

The term "electrically non-conductive fiber" refers to a fiber which has an electrical resistivity of at least [b ]$10^{11}$ ohms/square. The electrically non-conductive fibers typically have a length in the range from about 0.5 to about 7 mm, a diameter in the range from about 15 to about 50 micrometers, and an aspect ratio in the range from about 40 to about 160.

The present invention provides a second coated abrasive article which comprises:

(a) a backing comprising at least two plies and an innerlayer interposed between at least two of the plies, the innerlayer comprising an electrically conductive material; and (b) an abrasive layer bonded to one major surface of the backing, wherein the electrically conductive material is present in an amount sufficient to reduce accumulation of static electric charge in the coated abrasive article during the abrading of a workpiece.

The electrically conductive material can be in any of a variety of shapes including, for example, spheres, flakes, squares, pyramids, fibers, etc., and with regard to the second embodiment described above, can be in the shape of a sheet.

The term "electrically conductive material" or "electroconductive material" refers to materials having sufficient electrical conductivity such that when incorporated into a coated abrasive article as herein described the buildup of static electricity during the use of the coated abrasive article is significantly reduced as compared to a coated abrasive which has a backing which does not contain such electrically conductive material. Preferably, the electrically conductive material has an electrical resistivity of less than 2,000 kilo-ohms per square. More preferably, the electrically conductive material has an electrical resistivity of less than 500 kilo-ohms per square. Most preferably, the electrical resistivity of the electrically conductive material is less than 100 kilo-ohms per square.

For electrically conductive materials having suitable dimensions, the electrical resistivity can be measured by placing the probes of an ohmmeter 1.4 cm apart on the electrically conductive material. Suitable ohmmeters are commercially available and include, for example, those available under the trade designations "Beckman Industrial Digital Multimeter," Model 4410 from Beckman Industrial Corp. of Brea, Calif.; and "Industrial Development Bangor Surface Resistivity Meter," Model 482 from Industrial Development Ltd. of Bangor Gwynned, Wales).

Preferably, the electrically conductive material forms a continuous network.

A method for making the first coated abrasive article comprises the steps of:

(a) providing a nonwoven, fibrous backing comprising at least one ply, wherein the ply comprises electrically non-conductive fibers and electrically conductive material; and (b) applying an abrasive layer to a major surface of said backing, wherein the electrically conductive material is at least one of electrically conductive fibers selected from the group consisting of graphite fibers, carbon fibers, metal fibers, electrically conductive polymer fibers, graphite coated fibers, carbon coated fibers, metal coated fibers, electrically conductive polymer coated fibers, and combinations thereof; and electrically conductive particles selected from the group consisting of graphite particles, carbon particles, metal particles, electrically conductive polymer particles, graphite coated particles, carbon coated particles, metal coated particles, electrically conductive polymer coated particles, and combinations thereof; and wherein the electrically conductive material is present in an amount sufficient to provide a coated abrasive article having a reduced tendency to accumulate static electric charge during the abrading of a workpiece.

A method for making the second coated abrasive article comprises the steps of:

(a) providing a backing comprising at least two plies and an innerlayer interposed between at least two of the plies, the innerlayer comprising an electrically conductive material; and (b) applying an abrasive layer to a major surface of the backing, wherein the electrically conductive material is present in an amount sufficient to provide a coated abrasive article having a reduced tendency to accumulate static electric charge during the abrading of a workpiece.

In regard to the second coated abrasive article, the outer major surfaces (i.e., the front side and the back side) of the backing used to prepare the coated abrasive article according to the present invention is not affected by the presence of the conductive layer such that there is no requirement to select particular adhesive formulations or inks for manufacturing the abrasive since the conventional compositions may be employed. In addition, the ability to print information, such as the type and grade of abrasive mineral, on the backside (i.e., non-abrasive side) of the backing is not impaired by the presence of the electrically conductive material within the backing. Further the disadvantages inherent with the use of dark colored electrically conductive layers based on carbon black on the backside of the backing, which may limit use of coated abrasive belts on machines having infra-red sensors for tracking purposes, is avoided by a coated abrasive article according to the present invention. Furthermore, the electrically conductive material does not significantly interfere with the structural integrity of the abrasive backing.

The coated abrasive article may be in any conventional form including those having an abrasive layer comprising a make layer, abrasive grains, a size layer, etc., and other functional layers (e.g., a supersize layer), and those having a monolayer as an abrasive layer comprising a slurry layer comprising a bond system and abrasive grain, and other functional layers. The backing of the coated abrasive optionally has a presize coating, a backsize coating, a saturant, or combinations thereof.

The inventive coated abrasive article provides a solution to the serious static electricity build-up problem associated with abrading a workpiece with a coated abrasive article.

DETAILED DESCRIPTION OF THE PREFERRED EMBODIMENT

This invention pertains to a coated abrasive article which is made electrically conductive by incorporating electrically conductive material therein.

The coated abrasive article of the present invention may take any of the variety of embodiments, as will be explained below.

First Coated Abrasive Article

Figure 1:
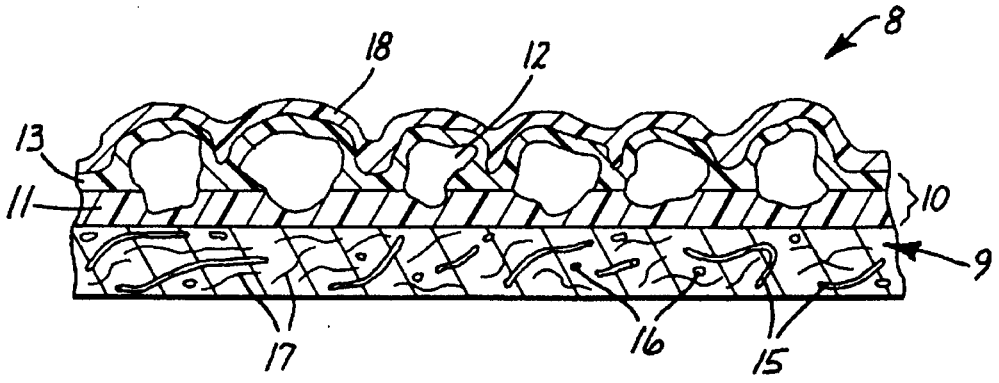
FIG. 1 is an enlarged cross-sectional view of an embodiment of a coated abrasive article made in accordance with the present invention.

Referring to FIG. 1, coated abrasive 8 comprises nonwoven, fibrous backing 9 having plurality of abrasive granules 12 bonded to backing 9 by means of bond system 10 which typically consists of first bond coat 11 (generally referred to as a "make" coat or "make" layer) and second bond coat 13 (generally referred to as a "size" coat or "size" layer). Make coat 11 secures abrasive granules 12 to backing 9 and size coat 13 further reinforces abrasive grains 12. Alternatively, bond system 10 consists of a single bond coat (e.g., a slurry coat).

Nonwoven, fibrous backing 9 includes electrically nonconductive fibers 17 and at least one of electrically conductive fibers 15 and electrically conductive particles 16.

Coated abrasive 8 may also contain supersize coat 18. The purpose of the supersize coat is to reduce the amount of loading. "Loading" is the term used to describe the filling of spaces between abrasive grains with swarf (the material removed from the workpiece) and the subsequent build-up of that material. For example, during wood sanding, swarf comprised of wood particles becomes lodged in the spaces between abrasive grains, dramatically reducing the cutting ability of the grains.

Figure 2:
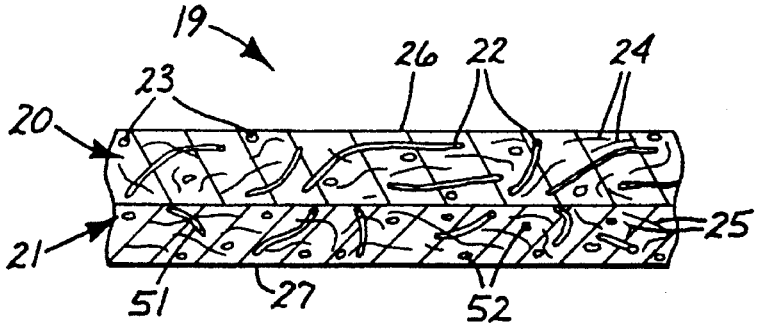
FIGS. 2–3 are enlarged cross-sectional views of various backings in accordance with the present invention.
Figure 3:
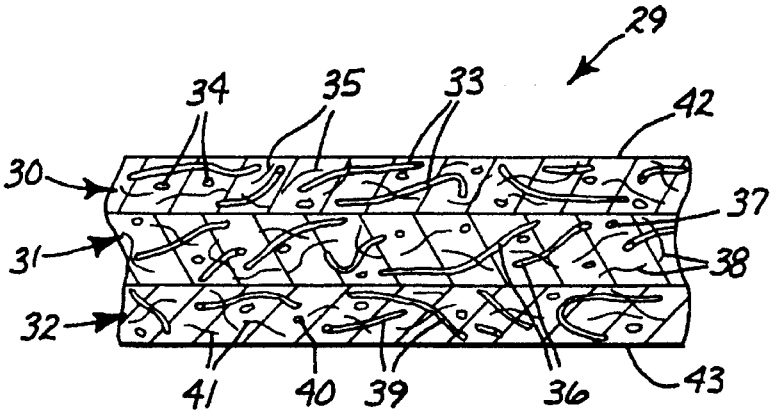

Examples of alternative electrically conductive backing embodiments useful in the coated abrasive article of the present invention are depicted in FIGS. 2 and 3.

Referring to FIG. 2, electrically conductive nonwoven, fibrous backing 19 comprises first ply 20 and second ply 21. Plies 20 and 21 each include electrically non-conductive fibers 24 and 25 and collectively include at least one of electrically conductive fibers 22 and 51 and electrically conductive particles 23 and 52. A coated abrasive layer can be applied to exposed surface 26 or 27.

Referring to FIG. 3, electrically conductive nonwoven, fibrous backing 29 comprises first ply 30, second ply 31, and third ply 32. Plies 30, 31, and 32 each include electrically non-conductive fibers 35, 38, and 41 and collectively include at least one of electrically conductive fibers 33, 36, and 39 and electrically conductive particles 34, 37, and 40. A coated abrasive layer can be applied to exposed surface 42 or 43.

The preferred electrically conductive materials are carbon particles, carbon fibers, graphite particles, graphite fibers, metallic particles, metallic fibers, electrically conductive polymeric particles, electrically conductive polymeric (e.g., polypyrrole, polyacetylene, and polyaniline) fibers, and combinations thereof.

Preferably, at least one ply comprising the nonwoven, fibrous backing comprises electrically conductive material in the range from about 0.75 to about 15 percent by volume, based on the total volume of the ply and the electrically conductive material comprising the ply. More preferably, at least one ply comprises electrically conductive material in the range from about 4 to about 12 percent by volume, and most preferably, at least one ply comprises electrically conductive material in the range of about 5 to about 8 percent by volume.

Preferably, the shape of the electrically conductive material is at least one of fibers and particles, wherein "electrically conductive fiber" refers to an electrically conductive filament, preferably having a diameter in the range from about 2 to about 20 micrometers and a length of up to about 2 cm. More preferably, the electrically conductive fibers have a length in the range from about 0.1 to about 1 cm. The electrically conductive fibers preferably have a high aspect ratio. The higher the aspect ratio of the fibers, generally the lower the amount of such fibers needed to render the article sufficiently electrically conductive to reduce the static electric problems associated with conventional coated abrasives during the abrading of electrically insulating workpieces. Preferably, the electrically conductive particles can pass through a 200 mesh sieve (i.e., having 75 micrometer openings). More preferably, the largest dimension of the particles is in the range from about 45 to about 75 micrometers. Although particle sizes outside of the preferred ranges are useful, particles that cannot pass through the 200 mesh sieve tend to be more difficult to incorporate into the backing in a controlled manner. Such particles, for example, tend to settle in the wood pulp dispersion used to make the backing, thereby reducing the control in distributing the particles as desired.

The most preferred electrically conductive material is carbon fibers. Preferably, the backing comprises carbon fibers in the range from about 5 to about 25 weight percent, based on the total weight of the backing and the carbon fibers comprising the backing. More preferably, carbon fibers comprise in the range from about 5 to about 15 weight percent, and most preferably in the range from about 7 to about 12 weight percent.

For a backing comprising electrically conductive carbon material, it is preferable that the carbon content of the carbon material is at least 80 percent by weight. More preferably, the carbon content of the electrically conductive carbon material is at least 90 percent by weight.

Useful electrically conductive metals include, for example, stainless steel, nickel, aluminum, silver, and combinations thereof. Useful electrically conductive polymeric materials include, for example, polyaniline, polypyrroles, polyacetylene, polyparaphenylene, and combinations thereof.

The preferred size of the electrically conductive material is based on compatibility with the method of making the paper.

Methods for making carbon fibers are known in the art. For example, U.S. Pat. No. 3,011,981 (Soltes), the disclosure of which is incorporated herein by reference, teaches carbon fibers made by heating cellulosic materials in the absence of oxygen and moisture at a temperature between 120° and 815° C. until substantial carbonization has occurred. The carbonized material is then subjected to a temperature above 815° C. for a time sufficient to render the carbonized material electrically conductive.

Carbon fibers are commercially available, for example, from Amoco Chemicals Corp. of Chicago, Ill., and Concordia Mfg. Co. of West Warwick, R.I.

Methods known in the art for making graphite fibers include that disclosed in U.S. Pat. No. 3,635,675 (Ezekiel), the disclosure of which is incorporated herein by reference.

Graphite fibers are also commercially available, for example, from Fibre-Glast Developments Corp. of Dayton, Ohio, and Hercules Aerospace Co. of Magna, Utah.

Commercially available carbon particles include those from Cabot Corp. of Waltham, Mass.

Commercially available graphite particles include those from Lonza of Fairlawn, N.J.

Metallic particles commercially available include, for example, nickel particles from Novamet of Wyckoff, N.J. Commercially available metallic fibers include, for example, stainless steel fibers marketed under the trade designation "BEKISHIELD" from Bekaert Fiber Technology of Marietta, Ga.; and nickel fibers marketed under the trade designation "FIBREX" from National Standard Co. of Niles, Mich.

Electrically conductive polymeric particles or powders are commercially available (e.g., polyaniline powder is available from Uniax of Santa Barbara, Calif.). Electrically conductive polymeric fibers are commercially available, for example, from Milliken & Co. of Spartanburg, S.C., under the trade designation "CONTEX" (natural and synthetic fibers treated, for example, with polypyrrole). Methods for depositing carbon, graphite, metallic, and electrically conductive polymeric coating onto particles and fibers are known in the art (see, e.g., U.S. Pat No. 4,696,835, Maus et al., the disclosure of which is incorporated herein by reference).

Metal coated fibers and particles are commercially available and include, for example, silvered fibers from Pofleis Industries of Harsbrouck Heights, N.J.; and nickel coated mica from Suzorite Mica Corp. of Boucherville, Quebec, Canada.

The electrically conductive material can be incorporated into conventional nonwoven, fibrous coated abrasive backing materials which comprise electrically non-conductive conductive fibers (e.g., paper backings, fiber backings, etc.). The preferred backing is paper.

Preferred electrically non-conductive fibers include, for example, cellulosic fibers (i.e., fibers derived from hardwood pulp or softwood pulp), cotton fibers, or combinations thereof. The non-woven, fibrous backing may further comprise other electrically non-conductive fibers such as synthetic fibers (e.g., polyester fibers, polypropylene fibers, glass fibers, polyvinyl alcohol fibers, polyimide fibers, rayon fibers, nylon fibers, and polyethylene fibers), natural fibers (e.g., fibers of hemp, kapok, flax, sisal, jute, manila, and combinations thereof), and combinations thereof.

Preferably, the electrically conductive material forms a continuous network. Such a network can be formed, for example, by having the fibers or particles of electrically conductive material touching at least one adjacent fiber or particle, or by having the fiber or particle in close proximity to each other. The anti-static properties of a coated abrasive article comprising a backing having such a network generally demonstrate superior antistatic properties as compared to a coated abrasive article comprising a backing which does not have such a network.

The electrically conductive backing may further comprise a binder which serves to reinforce the backing and to hold various components of the backing together. Such binders are known in the art and include, for example, polymeric latices (e.g., polyacrylates or ethylene/vinyl acetate copolymers), rubber (e.g., styrene/butadiene, neoprene, and butadiene/nitrile), and combinations thereof.

Methods known for incorporating electrically conductive fibers in paper or paper-type sheet material include, for example, those described in U.S. Pat. Nos. 3,367,851 (Filreis), 4,347,104 (Dressier), and 4,909,901 (McAllister et al.), the disclosures of which are incorporated herein by reference.

The electrically conductive backing may further comprise at least one of a presize (i.e., a barrier coat overlying the major surface of the backing onto which the abrasive layer is applied), a backsize (i.e., a barrier coat overlying the major surface of the backing opposite the major surface onto which the abrasive layer is applied), and a saturant (i.e., a barrier coat that is coated on all exposed surfaces of the backing). Preferably, the electrically conductive backing comprises a presize. Suitable presize, backsize, or saturant materials are known in the art. Such materials include, for example, resin or polymer latices, neoprene rubber, butylacrylate, styrol, starch, hide glue, and combinations thereof.

Preferably, the surface resistivity of the backing comprises electrically conductive material is less than 2,000 kilo-ohms/square. More preferably, the surface resistivity of the backing is less than 1,000 kilo-ohms/square, and, most preferably, it is less than about 500 kilo-ohms/square. The surface resistivity is measured by placing the probes of an ohmmeter 1.4 cm apart on a major surface of the backing.

Some electrically conductive backings may have the electrically conductive material incorporated therein such that the surface resistivity of a major surface of the backing does not have an electrical resistivity less than 2,000 kilo-ohms per square (see, e.g., the backings shown in FIGS. 2 and 3). However, when an abrasive article in accordance with the present invention having such a backing is used, one skilled in the art will readily realize that the backing is sufficiently electrically conductive because the static electricity will be dissipated.

Second Coated Abrasive Article

Figure 4:
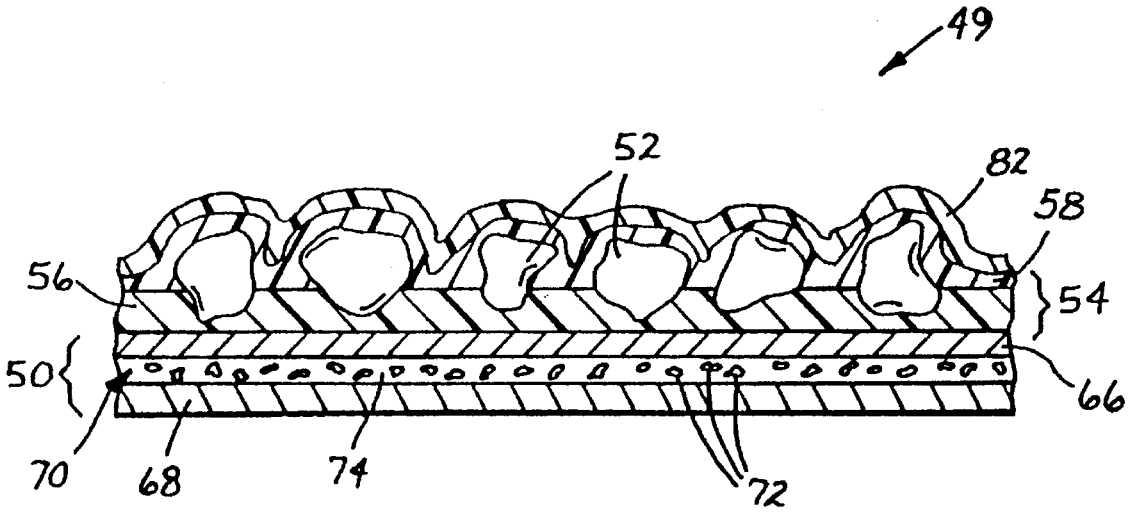
FIG. 4 is an enlarged cross-sectional view of another embodiment of a coated abrasive article made in accordance with the present invention.

Referring to FIG. 4, coated abrasive 49 comprises backing 50 having plurality of abrasive granules 52 bonded to backing 50 by means of bond system 54 which typically consists of first bond coat 56 (generally referred to as a "make" coat or "make" layer) and second bond coated 58 (generally referred to as a "size" coat or "size" layer). Alternatively, bond system 54 consists of a single bond coat (e.g., a slurry coat).

Backing 50 includes plies 66 and 68, and innerlayer 70. Innerlayer 70 comprises electrically conductive material 72 and optional binder 74.

Coated abrasive 49 may also contain supersize coat 82.

The innerlayer can be essentially free of each of cellulosic fibers and cotton fibers.

The plies of the backing may be formed from any suitable material known in the art, including strong papers, polymeric films, fabrics or cloth, e.g., cotton, and woven and non-woven webs of both natural and synthetic polymeric fibers. The ply material preferably has a significantly lower electroconductivity than the innerlayer, i.e., it is at least semi-insulating. More preferably, the ply material is a non-conductor (i.e., has an electrical resistivity of at least $10^{11}$ ohms/square). A preferred ply material is paper having a weight in the range from about 70 to 300 g/m$^2$. Preferably, a paper ply has a weight in the range from about 120 to about 200 g/m$^2$.

The optional innerlayer binder desirably has adhesive properties to bond the innerlayer to the plies. Examples of suitable innerlayer binders include glues obtained from bones (animal glue), gelatin, starch and polymeric resins including phenolic resins, urea-formaldehyde resins, melamine-formaldehyde resins, epoxy resins, acrylate and modified acrylate resins, e.g., homopolymers and copolymers of esters of acrylic acid and methacrylic acid, other latex resins, and combinations thereof.

Suitable electroconductive materials include graphite, carbon black, metals and alloys thereof, electroconductive polymers, and combinations thereof. The most preferred electroconductive material is carbon black.

Commercially available graphite useful in the present invention include powdered or colloidal graphite (including a suspension of powdered graphite and oil). Powdered or colloidal graphite is available, for example, under the trade designations "DAG," "AQUADAG," and "OILDAG" from Acheson Colloids Company of Plymouth, Tex.

Useful commercially available metals and alloys thereof include aluminum, silver, gold, copper, iron, lead, tin, zinc, and combinations thereof. The metal may be a foil (e.g., tin foil or aluminum foil). A preferred metal alloy is bronze (e.g., a copper-based alloy strengthened with 1 percent by weight cadmium and 0.06 percent by weight tin).

Useful electrically conductive polymers include poly(vinylbenzyl trimethyl ammonium chloride), which is commercially available from Polysciences Inc. of Warrington, Pa, and those disclosed in U.S. Pat. No. 5,061,294 (Harmer et al.), the disclosure of which is incorporated herein by reference.

Other useful electrically conductive material may be hygroscopic salts (e.g., a quaternary salt, including that commercially available under the trade designation "EMERSTAT 6660A" from Emery Chemicals of Cincinnati, Ohio), N,N-bis (2-hydroxyethyl)-N-(3'-dodecyloxy-2'-hydroxypropyl) methylammonium methosulfate (commercially available as a solution, for example, from the American Cyanamid Company of Wayne, N.J., under the trade designation "CYSTAT 609"), stearamidopropyldimethyl-hydroxyethylammonium-dihydrogen phosphate (commercially available as a solution, for example, from the American Cyanamid Company under the trade designation "CYSTAT SP"), stearamidopropyldimethyl-B-hydroxyethylammonium nitrate (commercially available as a solution, for example, from the American Cyanamid Company under the trade designation "CYSTAT SN"), (3-lauramidopropyl) trimethylammonium methylsulfate (commercially available, for example, under the trade designation "CYSTAT LS" from the American Cyanamid Company), and n-alkyl-dimethylbenzyl ammonium chloride (commercially available, for example, from Onyx Chemical of Jersey City, N.J., under the trade designation "BTC-50USP")). For further details regarding hygroscopic salts, see U.S. Pat. No. 4,973,338 (Gaeta et al.), the disclosure of which is incorporated herein by reference.

Preferably, a humectant (e.g., glycerol, polyglycols, polyethylene glycols, polyethers, and polymers of alkylene oxides) is used with a hydroscopic salt.

The carbon black useful in the present invention is an amorphous modification of carbon, typically formed by the partial combustion of hydrocarbons, which has an outermost oxidized atomic layer due to the exposure to air. The carbon black which is typically aggregated, can be directly incorporated between two plies. Alternatively, the carbon black aggregates can be incorporated between two plies as a dispersion, preferably an aqueous dispersion. The latter is preferred as a dispersion of carbon black aggregates is usually easier to apply onto a major surface of a ply when the carbon black aggregates are dispersed in a liquid media. Further, if the carbon black aggregates are dispersed in a liquid media, prior to their addition to a binder precursor, a greater percentage of carbon black aggregates usually may be present in the innerlayer binder precursor while maintaining the proper coating viscosity for the aggregates/binder precursor. If the aggregates are not dispersed prior to their addition to the binder, the viscosity of the aggregates/binder precursor is higher, which may lead to processing difficulties.

Suitable aqueous dispersions of carbon black aggregates are commercially available from sources such as FDI Dispersions of Newark, N.J.

Preferably, the carbon black dispersion further comprises one or more dispersing aids. Typically examples of commercially available dispersion aids include those marketed under the trade designations "DAXAD 11G" from W. R. Grace of Lexington, Mass.; "LOMAR PWA" and "NOPCOSPERSE A-23" from Henkel Corporation of Ambler, Pa.; and "MARASPERSE CBOS-4" from Daishowa Chemicals Inc. of Rothschild, Wis.

The weight ratio of carbon black aggregates to dispersing aid preferably is in the range from about 2:1 to about 30:1. More preferably, the weight ratio is in the range from about 4:1 and about 12:1. If the amount of the dispersing aid is too low, the viscosity of the pre-dispersion may be excessive. On the other hand, if the amount of dispersing aid is too high unwanted recoagulation of the carbon black aggregates may occur. Preferably the dispersion comprises in the range from about 1 to about 25 percent by weight carbon black aggregates, based on the total weight of the dispersion.

The liquid media for the carbon black aggregate dispersion may be an aqueous, nonaqueous (e.g., an organic liquid), or a compatible combination thereof. The liquid media and dispersing aid chosen should be compatible with each other. To avoid the environmental concerns associated with organic liquids, the liquid media is preferably water.

As will be recognized by those skilled in the art, it is important to match the proper dispersing aid with the innerlayer binder. If the dispersing aid and the innerlayer binder are not compatible, the resulting aggregate/innerlayer binder precursor composition may be too viscous for easy application to a major surface of a ply. For example, an anionic dispersing aid is preferred with phenolic adhesive systems. One skilled in the binder art should be able to make such an assessment.

The aggregate/binder precursor is typically prepared by dispersing carbon black aggregates in a liquid medium (e.g., water) containing a dispersing aid, and then mixing the ingredients until a homogeneous dispersion is formed. The resulting dispersion is then added to the innerlayer binder precursor. If the liquid medium is water, the dispersing aid can be an anionic or non-ionic surfactant. Suitable dispersing aids include, for example, those commercially available under the trade designation "LOMAR PWA" and "NOPCOSPERSE A-23" from Henkel Corp. of Ambler, Pa. and "DAXAD 11G" from W. R. Grace & Co. of Lexington, Mass.

Preferably, the electrically conductive material forms a continuous network. Such a network can be formed, for example, by having particles of the electrically conductive material touching or by having particles of the electrically conductive material in close proximity to each other. The anti-static properties of a coated abrasive article comprising a backing having such a network generally demonstrate superior antistatic properties as compared to a coated abrasive article comprising a backing which does not have such a network.

Preferably, the concentration of carbon black in the innerlayer is high enough to provide a continuous electroconductive pathway throughout the coating. Since the electrical conductivity of carbon black is isotropic; that is, it does not rely on the juxtaposition of the carbon along a particular plane to yield an electroconductive path through the coating, the threshold concentration of carbon black required to provide a continuous electroconductive pathway throughout the coating is generally lower than the threshold concentration required for other electroconductive materials, such as graphite, in which the electrical conduction is anisotropic. Below the threshold concentration of carbon black there are only intermittent electroconductive pathways, formed by short chains of the amorphous carbon black aggregates, which is believed to explain the poor and/or erratic electrical conductivity of coated abrasives articles containing low loadings of carbon black. Preferably, carbon black is present in the innerlayer in an amount sufficient to provide an innerlayer with an electrical surface resistivity of a major surface of the backing of less than about 2000 kilo-ohms-cm, and most preferably, less than about 200 kilo-ohms-cm.

Carbon black aggregates useful in the invention include those formed of a multitude of smaller carbon black particles that are permanently fused together during the manufacturing process. Generally, these carbon black particles are nearly spherical with diameters ranging from about 10 nm to about 90 nm. The amount of carbon black in the innerlayer needed to lower the electrical surface resistivity of the backing to the range specified above depends on factors including the structure of the aggregate, the surface area of the aggregate, the surface chemistry of the aggregate and the size of the carbon black particles comprising the aggregate. For equal loadings of carbon black aggregates, reducing the size of the individual carbon black particles comprising the aggregates, while maintaining the other parameters constant, results in a reduction in the electrical surface resistivity of the abrasive article.

Preferably, the size of the carbon black aggregates is less than about 300 micrometers. More preferably, the size of the carbon black aggregates is in the range from about 125 to about 275 micrometers. A mixture of carbon black aggregates having two or more sizes of carbon black aggregates (e.g., a mixture of relatively large aggregates and relatively small aggregates) may also be used. Such mixtures tend to provide a more efficient distribution of carbon black aggregates in the binder.

The structure of carbon black aggregates refers to the size and configuration of the aggregate. High structure carbon blacks are composed of relatively highly branched aggregates while low structure carbon blacks are composed of relatively small compact aggregates. The structure of carbon black aggregates is characterized by the aggregate's void volume. High structure carbon black contains more void space than low structure carbon black because the former has a highly branched shape that prevents close packing. One common way of quantifying structure is the Dibutyl Phthalate Absorption Test. This test measures the volume of dibutyl phthalate (in ml) absorbed by 100 grams of carbon black, which is a measure of the amount of fluid required to fill the voids between aggregates. The dibutyl phthalate absorption can be used as a guide to structure level because, for a given surface area, the higher the structure, the higher the dibutyl phthalate absorption will be. For equal loadings of carbon black aggregates, increasing the structure of the carbon black aggregates used, while maintaining the other parameters constant, results in a reduction in the electrical surface resistivity of an innerlayer comprising a cured innerlayer binder and carbon black aggregates. Preferably, the carbon black aggregates have a dibutyl phthalate absorption in the range from about 50 to about 400 ml/100 g. More preferably, the dibutyl phthalate absorption is in the range from about 100 to about 400 ml/100 g.

In the manufacturing of carbon black, chemisorbed oxygen complexes, such as carboxylic, quinonic, lactonic and hydroxylic groups, typically form on the surface of the aggregates. These adsorbed molecules act as an electrically insulating layer. Decreasing the volatile content of the carbon black aggregates while maintaining the other parameters constant, results in a reduction of the electrical surface resistivity of an innerlayer comprising a cured innerlayer binder and carbon black aggregates. At volatile contents greater than about 4 percent by weight, based on the weight of the carbon black present, the carbon black aggregates are electrically non-conductive. Preferably, the volatile content of the carbon black aggregates is less than about 3 percent by weight, more preferably, less than about 2 percent by weight.

The reduction in the electrical surface resistivity of an innerlayer comprising binder and carbon black aggregates is also a function of the surface area of the carbon black aggregates. For equal loadings of carbon black aggregates, increasing the surface area of the carbon black aggregates, while maintaining the other parameters constant, results in a reduction in the electrical surface resistivity of the cured binder. Preferably, the surface area of the carbon black aggregates is in the range from about 100 to about 1000 $m^2/g$. More preferably, the surface area of the carbon black aggregates in the range from about 130 to about 1000 $m^2/g$.

Preferably, the total solid content of an uncured innerlayer binder according to the present invention is in the range from about 20 to about 75 percent by weight. More preferably, the total solids content is in the range from about 35 to about 65 percent by weight.

In another aspect, the viscosity at 25° C. of an uncured innerlayer binder according to the present invention is preferably in the range from about 25 to 2000 cps. The viscosity is preferably measured using a Brookfield viscometer (e.g., a Brookfield Model DV-II digital viscometer from Brookfield Engineering Laboratories, Inc. of Stoughton, Mass.) with a number 2 spindle at 20 rpm. More preferably, the viscosity at 25° C. of the uncured innerlayer binder is in the range from about 100 to about 1000 cps, and most preferably, in the range from about 100 to about 750 cps.

The innerlayer binder can be cured by conventional means including heat.

The innerlayer of electrically conductive material can be incorporated into the backing of the coated abrasive article during the fabrication of the backing or during any convenient or desired time thereafter. If incorporated into the backing after fabrication of the backing, one or more plies comprising the backing can be removed. The electrically conductive material can then be applied to the newly exposed surface of the backing, for example, by coating a dispersion of the electrically conductive material, or by coating a dispersion/binder composition. The ply(s) that is removed can then be reattached to the backing, for example, by using an adhesive such as glue, or if the innerlayer comprises a binder, the binder may serve as the adhesive.

Coated Abrasive Construction

With the exception of the electrically conductive backing, the inventive coated abrasive articles can be prepared using materials and techniques known in the art for constructing coated abrasive articles.

The preferred bond system is a resinous or glutinous adhesive. Examples of typical resinous adhesives include phenolic resins, urea-formaldehyde resins, melamine-formaldehyde resin, epoxy resins, acrylate resins, urethane resins, and combinations thereof. The bond system may contain other additives which are well known in the art, such as, for example, grinding aids, plasticizers, fillers, coupling agents, wetting agents, dyes, and pigments.

Preferably, the abrasive grains are selected from such known grains as fused aluminum oxide, heat-treated aluminum oxide, ceramic aluminum oxide, co-fused alumina-zirconia, garnet, silicon carbide, diamond, cubic boron nitride, and combinations thereof.

Examples of useful materials which may be used in the supersize coat include the metal salts of fatty acids, urea-formaldehyde, novolak phenolic resins, waxes, mineral oils, and fluorochemicals. The preferred supersize is a metal salt of a fatty acid such as, for example, zinc stearate.

In the first preferred conventional method for preparing a coated abrasive article, a make coat is applied to a major surface of the electrically conductive backing followed by projecting a plurality of abrasive grains into the make coat. It is preferable in preparing the coated abrasive that the abrasive grains be electrostatically coated. The make coating is cured in a manner sufficient to at least partially solidify it such that a size coat can be applied over the abrasive grains.

Next, the size coat is applied over the abrasive grains and the make coat. Finally, the make and size coats are fully cured. Optionally, a supersize coat can be applied over the size coat and cured.

In the second preferred conventional method for preparing a coated abrasive article, a slurry containing abrasive grains dispersed in a bond material is applied to a major surface of the backing. The bond material is then cured. Optionally, a supersize coat can be applied over the slurry coat and cured.

The coated abrasive article according to the present invention can be in the shape of conventional coated abrasive articles, for example, belts, discs, sheets, and strips. The most preferred shape is a belt.

In the above methods, the make coat and size coat or slurry coat can be solidified or cured by means known in the art, including, for example, heat or radiation energy.

The coated abrasive article according to the present invention can be in the shape of conventional coated abrasive articles, for example, belts, discs, sheets, and strips. The most preferred shape is a belt.

The incorporation of the electrically conductive backing into the coated abrasive construction provides certain desirable antistatic properties. Although not wanting to be bound by theory, it is believed that the electrically conductive coated abrasive according to the present invention rapidly dissipates static electricity generated during the abrading of electrically insulating workpieces. When the static electricity is dissipated, the workpiece dust particles generated in the abrading operation are removed by the normal exhaust systems. If the static electricity is not dissipated, the workpiece dust particles carry a charge, and may not be removed as readily by the normal exhaust system.

The present invention provides a coated abrasive article which provides a solution to the serious static electricity build-up problem associated with abrading a workpiece with a coated abrasive article.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

Procedure for Making a Coated Abrasive Article

An unfilled phenol resorcinol formaldehyde resin make coat (64% solids) was applied to a major surface of the backing specified in the example or control to provide an add-on wet weight of about 45 ±5 grams/square meter. Immediately thereafter, grade P150 fused aluminum oxide abrasive was electrostatically projected into the make coat to provide an add-on weight of 132 ±8 grams/square meter. The make coat was precured for 90 minutes at 88° C. in a forced air oven. Next, a calcium carbonate filled resole phenolic resin size coat (76% solids) was coated over the make coat and abrasive granules to provide a wet add-on weight of 59 ±8 grams/square meter. The make and size coat were then final cured for 10 hours at 100° C. The resulting coated abrasive was then conventionally flexed and rehumidified to prevent the paper from becoming brittle.

Procedures for Testing the Coated Abrasive

Test Procedure I

The coated abrasive was then converted into 16 cm by 762 cm endless coated abrasive belts and installed on an Oakley Model D Single Belt Stroke Sander. The coated abrasive belt abraded three red oak workpieces for seven minutes each. The pressure at the interface was approximately 0.20 Newton/square centimeter. The belt speed corresponded to about 1670 surface meters per minute. The amount of red oak removed (cut) was measured and the amount of dust (swarf) collected on metal plate immediately past the workpiece holder was determined. The amount of red oak removed was divided by the amount of dust collected to generate a dimensionless "Dust Efficiency Factor" (DEF). High values of the DEF indicate that the production of dust uncollected by the exhaust system was low.

Test Procedures II

Test Procedure II is the same as Test Procedure I except six red oak workpieces were abraded for about 5 minutes each.

EXAMPLE 1

Backing Prep

A 3-ply, 0.32 mm thick backing having a basic weight of about 280 g/m$^2$ was prepared as described in U.S. Pat. No. 4,909,901 (McAllister et al.), the disclosure of which is incorporated herein by reference. The two outer plies were formed from a cellulose blend containing montmorillonite clay in an amount sufficient to eliminate the capacitor effect between the outer ply and the inner plies. The outer plies had a surface electrically conductivity of about $10^{10}$ ohms/square. The inner ply was formed from a carbon fiber/cellulose blend containing about 10 percent of 1.25 cm (0.5 inch) long carbon fibers (commercially available under the trade designation "CARBOFLEX" of Ashland Oil Company of Ashland, Ky.

Specifically the backing was prepared using a conventional wet paper making machine using three vats. The vats supplying the feed for the two outer plies contained a 3 percent solids aqueous dispersion wherein the solids comprised bleached northern softwood Kraft wood pulp (commercially available under the trade designation "HARMAC R" from MacMillian Bloedel of Nanaimo, British Columbia). The vat supplying the feed for the inner ply contained a 3 percent solids aqueous dispersion wherein the solids comprised about 90 percent bleach northern softwood Kraft wood pulp ("HARMAC R") and about 10 percent of the carbon fibers.

The external surfaces of the outer plies were coated with an aqueous dispersion comprising about 10 percent montmorillonite clay (commercially available under the trade designation "VAN GEL B" from R. T. Vanderbilt Company of Norwalk, Conn.) using a conventional vertical size press. The coated backing was then steam dried using a heated drier can. The dried coated backing had a surface electrical resistivity of about $10^8$ ohms/square at 50% relative humidity.

A coated abrasive article was prepared using this backing according to the method entitled "Procedure for Making a Coated Abrasive Article," above. The abrasive layer was coated on the felt side.

The coated abrasive article was tested according to "Test Procedure I," above. The results are shown in Table 1 below.

TABLE 1

| Example | Amount of Workpiece Removed, Grams | Amount of Dust Collected Grams | DEF |
|---|---|---|---|
| 1 | 811 | 11 | 73.7 |
| Control A | 596 | 221 | 2.7 |

Control A

A control coated abrasive article was prepared and tested in the same manner as Example 1 except the backing was an E weight cylinder paper (basis weight of about 240 g/m).

It can be seen from the above data that the use of the electrically conductive backing significantly increased the cut (i.e., the amount of workpiece removed) and dramatically reduced the amount of dust (i.e., swarf) accumulated.

EXAMPLE 2

A backing was prepared as described in Example 1 except the backing had four plies, and the carbon fibers were in outer ply on the "wire side." The other three plies did not contain electrically conductive material.

A coated abrasive article was prepared using this backing according to the method entitled "Procedure for Making a Coated Abrasive Article" above. The abrasive layer was coated on the "felt side."

The coated abrasive article was tested according to "Test Procedure II" above. The results are shown in Table 2 below.

TABLE 2

| Example | Amount of Workpiece Removed, Grams | Amount of Dust Collected Grams | DEFf |
|---|---|---|---|
| 2 | 596 | 0.6 | 993.3 |
| Control B | 510 | 80 | 6.4 |

It can be seen from the above data that the use of the electrically conductive backing significantly increased the cut (i.e., the amount of workpiece removed) and dramatically reduced the amount of dust (i.e., swarf) accumulated.

Control B

The Control B coated abrasive was a P150 closed coat, resin bond coated abrasive belt (commercially available under the trade designation "P150 3M 363I IMPERIAL RESIN BOND CLOSED COAT PAPER COATED ABRASIVE BELT" from the 3M Co. of St. Paul, Minn.).

It can be seen from the above data that the use of the electrically conductive backing significantly increased the cut (i.e., the amount of workpiece removed) and dramatically reduced the amount of dust (i.e., swarf) accumulated.

EXAMPLES 3–6

The static electric decay of several coated abrasive backings with or without an abrasive layer coated thereon were measured using a commercial static decay meter (Model 406 C STATIC DECAY METER; Electro-Tech Systems, Inc., of Glenside, Pa.), wherein each backing was charged to +5000 volts, and wherein the cutoff level of the static decay meter was set at 0%.

Example 3 was a 90 lb., 4 ply cylinder paper with 10 percent carbon black in all 4 plies, commercially available under from Specialty Coatings Group, Inc. of Richmond, Va, under the trade designation "CARBON BLACK SHIELDING MEDIA, GRADE 99126."

Example 4 was a 110 lb., 4 ply cylinder paper with 2.5 percent carbon black in all 4 plies, commercially available under from Specialty Coatings Group, Inc. under the trade designation "CARBON BLACK SHIELDING MEDIA, GRADE 99122."

Example 5, a 1 ply backing with nickel coated mica particles (commercially available from Suzorite Mica Corp. of Boucherville, Quebec, Canada), was prepared as follows. An industrial size blender (commercially available under the trade designation "WARING BLENDOR" from Waring Products Div., Dynamic Corp. of America of New Hartford, Conn.) was charged with water, bleached northern softwood Kraft wood pulp ("HARMAC R"), and nickel coated mica in amounts sufficient to provide a 3 percent solids dispersion having a 4:1 weight ratio of wood pulp to nickel coated mica. The ingredients were thoroughly mixed in the blender. The resulting dispersion was transferred to a Noble and Wood sheet machine (commercially available from Noble and Woods Machine Co. of Hoosick Falls, N.Y.). The dispersion was then diluted with water to provide a 0.5 percent solids aqueous dispersion. A sheet was made using the sheet machine. The sheet was lightly pressed between two felt pads to remove some of the water, and then dried on a heated drier can.

Example 6, a 1 ply, E wt. backing with about 50 percent stainless steel flake (particles) (commercially available from Novamet Corp. of Wyckoff, N.J.), was prepared as described for Example 5 except the solids portion of the dispersion comprised about 40 percent bleached northern Kraft wood pulp ("HARMAC R"), about 10 percent of the stainless steel flake, and about 10 percent acrylic latex (commercially available under the trade designation "HYCAR 2671" from B. F. Goodrich of Cleveland, Ohio).

Prior to making the static decay measurements, each sample was conditioned for about 12 days by placing it in a chamber having a relative humidity of about 35 percent. The conditioned samples were cut into pieces about 7.6 cm (3 inches) by about 12.7 cm (5 inches). The average of four static decay measurements for each sample are given in Table 3, below. The measurements were made on the backside (i.e., the felt side) of the sample (i.e., the side opposite that which the abrasive layer was or would be coated on).

Control C was an E wt. cylinder paper commercially available under the trade designation "130 # CYLINDER SAND (P0502-0)" from Specialty Coatings Group, Inc.

Control D was an F wt. cylinder paper commercially available under the trade designation "165 # CYLINDER SAND (P0502-0)" from Specialty Coatings Group, Inc.

Comparative I, an E wt., 1 ply backing with about 50.3 percent (12.8 volume percent) iron powder (commercially available under the trade designation "CARBONYL IRON" from G.A.F. Chemical of Wayne, N.J.) was prepared as described in Example 5 except the 3 percent solids aqueous dispersion comprised 39.7 percent northern softwood Kraft wood pulp ("HARMAC R"), 10 percent acrylic latex ("HYCAR 2671"), and 50.3 percent of the iron powder.

TABLE 3

| Example | Description | Time to discharge +5000 volts, sec. |
|---|---|---|
| 1A–2A | Coated abrasive backing used to prepare Examples 1 and 2 | 0.01 or less |
| 1 | Example 1 | 0.02 |
| Control A | | 0.08 |
| 2 | Example 2 | 0.02 |
| Control B | | 0.12 |
| Control C | E wt. cylinder paper | 0.06 |
| Control D | F wt. cylinder paper | 0.06 |
| 3 | 90 lb. cylinder, 1 ply paper with 10 wt % carbon black | 0.01 or less |
| 4 | 110 lb. cylinder ply paper with 2.5 wt % carbon black | 0.01 |
| 5 | E wt. cylinder paper with 20 wt % nickel coated mica particles | 0.01 or less |
| 6 | E wt. cylinder paper with 50 wt % stainless steel flake (particles) | 0.02 |
| Comparative I | E wt. cylinder paper with 50.3 wt. % (12.8 volume %) iron powder | 0.40 |

The above static electric decay measurements illustrate the reduction of static electric build-up in paper suitable for use as coated abrasive backings or a coated abrasive article having a paper backing wherein a sufficient amount of electrically conductive material has been incorporated therein. The "time to discharge +5000 volts" value for Comparative I was surprising. It was expected that the Comparative I construction would have a "time to discharge +5000 volts" value similar or the same as that recorded for Examples 1A–2A and 1–6. A backing having the Comparative I construction was not made into a coated abrasive article. Based on a comparison of the grinding data and static decay measurements above, it appears that a coated abrasive article having a backing with the Comparative I construction would not exhibit a reduction in the accumulation of static electric charge in the coated abrasive article during the abrading of a workpiece. The reason why the Comparative I construction provided such a high "time to discharge +5000 volts" value is unknown. One possible explanation is that the iron particles, or a portion thereof), oxidized during preparation of the Comparative I construction, providing an electrically insulating material rather than an electrically conducting material.

EXAMPLE 7

Example 7 was prepared as follows. A P150 coated abrasive belt (for woodworking) having a cylinder paper backing (2740 mm×100 mm; 300 g/m$^2$), a phenolic resin make and size, and semi-friable alumina abrasive particles was prepared using conventional techniques. The surface ply of the printside of the abrasive belt was delaminated. This ply was coated with a dispersion of carbon black having the following formulation:

60 percent water;

8 percent of a sodium naphthalene sulphonate-formaldehyde copolymer dispersing agent (commercially available under the trade designation "DAXAD 11G" from W. R. Grace & Co. of Lexington, Mass.)/water mixture (23 parts dispersing agent: 77 parts water);

16 percent carbon black (commercially available under the trade designation "VULCAN XC-72R" from Cabot Corporation of Boston, Mass.); and 16 percent ethylene glycol monoethyl ether The coated dispersion was then dried for about 15 minutes at about 90° C. The ply was then reattached to the coated abrasive using an acrylic copolymer pressure sensitive adhesive (commercially available under the trade designation "VANTAC 343" from Bevaloid Ltd. of Beverley, North Humberside, United Kingdom) to create a carbon black innerlayer within the paper backing.

The abrading performance of the resulting coated abrasive belt was then tested by abrading 10 pine workpieces for a period of 30 seconds each using a backstand belt machine (trade designation "MEGGAMASTER") from Meggit Engineering Ltd. of Bournemouth, UK. A constant load was applied using a handheld force gauge. The contact area was about 6.5 cm$^2$ (1 in.$^2$). The speed of the abrasive belt was about 20 meters/second (4000 feet/minute).

The Control E coated abrasive belt prepared and tested as described for Example 7, except the belt was not delaminated, nor was electrically conductive material incorporated therein.

Control E produced a significant accumulation of wood dust on the metal cladding parts of the belt machine after only five minutes of abrading. After an equivalent period of abrading with the Example 7 belt, the machine remained clean demonstrating that good dust control was being achieved.

EXAMPLE 8

A commercially available woodworking paper belt P180 (available under the trade designation "3M 250 UZ" from the 3M Company), which includes on the printside of the belt a carbon black-based electrically conductive ink (commercially available under the trade designation "LORRILEAUX 62120 ANTI-STATIC INK" from Lorrileaux International of France), was treated as follows. The ink-coated ply of the printside of the belt was delaminated. Using an adhesive (commercially available under the trade designation "3M DISC PAD ADHESIVE 08054" from the 3M Company), the ply was reattached to the coated abrasive such that the coated ink was sandwiched within the backing.

The resulting coated abrasive belt was then tested on pinewood as described in Example 7. Throughout the test period the machine remained clean, demonstrating the effectiveness of the presence of the electrically conductive ink within the backing at reducing the buildup of static electricity during the abrading of a workpiece.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising (a) a nonwoven, fibrous backing comprising at least one ply, wherein said ply comprises electrically non-conductive fibers and electrically conductive material; and (b) an abrasive layer bonded to one major surface of said backing;

wherein said electrically conductive material is at least one of electrically conductive fibers selected from the group consisting of graphite fibers, carbon fibers, metal fibers, electrically conductive polymer fibers, and combinations thereof; or electrically conductive particles selected from the group consisting of graphite particles, carbon particles, metal particles, electrically conductive polymer particles, and combinations thereof; and wherein said electrically conductive material is incorporated into said backing in an amount sufficient to reduce accumulation of static electric charge in said coated abrasive article during abrading of a workpiece.

2. The coated abrasive article according to claim 1 which is a belt.

3. The coated abrasive article according to claim 2 wherein said ply comprises in the range from 0.75 to about 15 percent by volume of said electrically conductive material, based on the total volume of said ply and said electrically conductive material comprising said ply.

4. The coated abrasive article according to claim 2 wherein said ply comprises in the range from about 4 to about 12 percent by volume of said electrically conductive material, based on the total volume of said ply and said electrically conductive material comprising said ply.

5. The coated abrasive article according to claim 2 wherein said ply comprises in the range from about 5 to about 8 percent by volume of said electrically conductive material, based on the total volume of said ply and said electrically conductive material comprising said ply.

6. The coated abrasive article according to claim 2 wherein the largest dimension of said electrically conductive particles is less than about 75 micrometers.

7. The coated abrasive article according to claim 2 wherein said electrically conductive fibers have a length in the range from about 0.1 to about 2 centimeters.

8. The coated abrasive article according to claim 2 wherein said electrically conductive fibers have a length in the range from about 0.1 to about 1 centimeter.

9. The coated abrasive article according to claim 2 wherein said electrically conductive fibers have a diameter in the range from about 2 to about 20 micrometers.

10. The coated abrasive article according to claim 2 wherein said electrically conductive material is at least one of electrically conductive fibers selected from the group consisting of graphite fibers, carbon fibers, metal fibers, electrically conductive polymer fibers, and combinations thereof; and electrically conductive particles selected from the group consisting of graphite particles, carbon particles, metal particles, electrically conductive polymer particles, and combinations thereof.

11. The coated abrasive article according to claim 2 wherein said electrically conductive material is carbon fibers.

12. The coated abrasive article according to claim 11 wherein said carbon fibers contain at least 80 percent by weight carbon.

13. The coated abrasive article according to claim 11 wherein said backing comprises in the range from about 4 to about 25 percent by weight of said carbon fibers, based on the total weight of said backing and said carbon fibers comprising said backing.

14. The coated abrasive article according to claim 2 wherein said backing comprises in the range from about 5 to about 25 percent by weight of said electrically conductive material, based on the total weight of said backing and said electrically conductive material comprising said backing, and wherein said electrically conductive material is carbon fibers.

15. The coated abrasive article according to claim 2 wherein said electrically non-conductive fibers are selected from the group consisting of cellulose fibers, cotton fibers, and combinations thereof.

16. The coated abrasive article according to claim 2 wherein said backing comprises at least two plies, said electrically conductive material being located essentially in at least one of said plies.

17. The coated abrasive article according to claim 2 wherein said backing comprises an inner ply interposed between two outer plies, said electrically conductive material being located essentially in at least one of said plies.

18. A method of making a coated abrasive article having a reduced tendency to accumulate static electric charge during the abrading of a workpiece, said method comprising the steps of:

(a) providing a nonwoven, fibrous backing comprising at least one ply, wherein said ply comprises electrically non-conductive fibers and electrically conductive material; and (b) applying an abrasive layer to a major surface of said backing, wherein said electrically conductive material is at least one of electrically conductive fibers selected from the group consisting of graphite fibers, carbon fibers, metal fibers, electrically conductive polymer fibers, and combinations thereof; or electrically conductive particles selected from the group consisting of graphite particles, carbon particles, metal particles, electrically conductive polymer particles, and combinations thereof; and wherein said electrically conductive material is incorporated into said backing in an amount sufficient to provide a coated abrasive article having a reduced tendency to accumulate static electric charge during the abrading of a workpiece.

19. The method according to claim 18 wherein said coated abrasive article is a belt.

20. The method according to claim 19 wherein said ply comprises in the range from about 0.75 to about 15 percent by volume of said electrically conductive material, based on the total volume of said ply and said electrically conductive material comprising said ply.

21. The method according to claim 19 wherein said ply comprises in the range from about 4 to about 12 percent by volume of said electrically conductive material, based on the total volume of said ply and said electrically conductive material comprising said ply.

22. The method according to claim 19 wherein the largest dimension of said electrically conductive particles is less than about 75 micrometers.

23. The method according to claim 19 wherein said electrically conductive fibers have a length in the range from about 0.1 to about 2 centimeters.

24. The method according to claim 19 wherein said electrically conductive fibers have a diameter in the range from about 2 to about 20 micrometers.

25. The method according to claim 19 wherein said wherein said electrically conductive material is at least one of electrically conductive fibers selected from the group consisting of graphite fibers, carbon fibers, metal fibers, electrically conductive polymer fibers, and combinations thereof; and electrically conductive particles selected from the group consisting of graphite particles, carbon particles, metal particles, electrically conductive polymer particles, and combinations thereof.

26. The method according to claim 19 wherein said electrically conductive material is carbon fibers.

27. The method according to claim 26 wherein said carbon fiber contains at least 80 percent by weight carbon.

28. The method according to claim 19 wherein said electrically non-conductive fibers are selected from the group consisting of cellulose fibers, cotton fibers, and combinations thereof.

29. The method according to claim 19 wherein said backing comprises at least two plies, said electrically conductive material being located essentially in at least one of said plies.

30. The method according to claim 19 wherein said backing comprises an inner ply interposed between two outer plies, said electrically conductive material being located essentially in at least one of said plies.

* * * * *

UNITED STATES PATENT AND TRADEMARK OFFICE

CERTIFICATE OF CORRECTION

PATENT NO. : 5,560,753
DATED : October 1, 1998
INVENTOR(S) : Herbert W. Schnabel, et al.

It is certified that error appears in the above-identified patent and that said Letters Patent is hereby corrected as shown below:

On the title page, item [73] Assignee, add—CPG Holdings Inc., Richmond, Va. --.

UNITED STATES PATENT AND TRADEMARK OFFICE

CERTIFICATE OF CORRECTION

PATENT NO.: 5,560,753

DATED: October 1, 1996

INVENTOR(S): Schnabel et al.

It is certified that error appears in the above-identified patent and that said Letters Patent is hereby corrected as shown below:

Item [56],
In the References Cited section, U.S. Patent No. 4,909,901 should be in the class of --162/125--.

In column 1, line 20, "fron" should be --from--.

In column 1, line 21, "electricity generated" should be --electricity is generated--.

In column 2, line 39, "and electrically" should be --or electrically--.

In column 2, line 50, "[b ]$10^{11}$" should be --$10^{11}$--.

In column 7, line 39, "Dressier" should be --Dressler--.

In column 15, line 39, "DEFf" should be --DEF--.

Signed and Sealed this

Ninth Day of June, 1998

*Attest:*

*Attesting Officer*

BRUCE LEHMAN

*Commissioner of Patents and Trademarks*